US007540242B2

(12) United States Patent
Sommerer

(10) Patent No.: US 7,540,242 B2
(45) Date of Patent: Jun. 2, 2009

(54) RUNNING GEAR FOR RAIL VEHICLES

(75) Inventor: Rudolf Sommerer, Jenbach (AT)

(73) Assignee: Evoinvent AG, Ebikon (CH)

( * ) Notice: Subject to any disclaimer, the term of this patent is extended or adjusted under 35 U.S.C. 154(b) by 0 days.

(21) Appl. No.: 12/013,594

(22) Filed: Jan. 14, 2008

(65) Prior Publication Data

US 2008/0196618 A1 Aug. 21, 2008

Related U.S. Application Data

(63) Continuation of application No. PCT/EP2006/006727, filed on Jul. 10, 2006.

(30) Foreign Application Priority Data

Jul. 13, 2005 (AT) ..... 1175/2005

(51) Int. Cl.
*B61F 5/00* (2006.01)

(52) U.S. Cl. ..... 105/166; 105/167; 105/168

(58) Field of Classification Search ..... 105/166, 105/165, 167, 168, 169, 218.2
See application file for complete search history.

(56) References Cited

U.S. PATENT DOCUMENTS

| | | | | |
|---|---|---|---|---|
| 1,341,779 | A | | 6/1920 | Boyden et al. |
| 3,212,456 | A | * | 10/1965 | Dilworth et al. ..... 105/196 |
| 3,333,551 | A | | 8/1967 | Gross et al. ..... 105/183 |

FOREIGN PATENT DOCUMENTS

| | | |
|---|---|---|
| DE | 576284 | 7/1934 |
| DE | 692777 | 6/1940 |
| DE | 852398 | 10/1952 |
| DE | 1605113 | 6/1966 |
| DE | 2118955 | 4/1971 |
| EP | 0046457 | 8/1981 |
| EP | 0765791 | 11/1994 |
| FR | 746013 | 6/1933 |
| FR | 825955 | 3/1938 |
| JP | 9-226575 | 9/1997 |

OTHER PUBLICATIONS

International search report, Oct. 12, 2006, (3 pgs).

* cited by examiner

*Primary Examiner*—Mark T Le
(74) *Attorney, Agent, or Firm*—Rissman Hendricks & Oliverio, LLP

(57) ABSTRACT

This invention comprises a running gear for rail vehicles with at least three wheel sets housed in a bogey frame and at least one steering device that makes possible a transverse displacement of an end wheel set, wherein the bogey frame, seen in longitudinal direction, has several sections, wherein at least the frontmost section, seen in the direction of travel, in which the leading wheel set is arranged, is connected horizontally pivotable to a second, rigid section, characterized in that at least the frontmost section, seen in the direction of travel, of the bogey frame in which the leading wheel set is arranged is formed as a parallelogram that can be displaced transversely to the longitudinal axis of the bogey frame.

39 Claims, 5 Drawing Sheets

RUNNING GEAR FOR RAIL VEHICLES

CROSS REFERENCE TO RELATED APPLICATIONS

This application is a continuation of PCT/EP2006/006727, filed Jul. 10, 2006, which claims priority from Austrian Application No. A 1175/2005, filed Jul. 13, 2005, is incorporated herein by reference.

BRIEF SUMMARY

The invention relates to a running gear for rail vehicles with at least three wheel sets housed in a bogey frame and at least one steering device that makes possible a transverse displacement of an end wheel set.

BACKGROUND OF THE INVENTION

In the case of rail vehicles in which the wheel sets are guided rigidly in longitudinal direction or parallel with little longitudinal play in the running gear frame, the parallel attitude results in the formation of increased transverse forces and increased wear mainly at the end wheel sets because the outer rail is struck at an acute striking angle.

In the case of two or multi-axle running gears it is already known to steer the end wheel sets into an approximately radial attitude by displacement transversely to the direction of travel by means of longitudinal pull rods arranged at an angle to the longitudinal direction of the vehicle, wherein the outward turning of the longitudinal pull rods arranged at an angle creates a longitudinal displacement of the wheel set bearings which is opposed left and right in each case.

To relieve the rail of additional forces which result from the secondary bending of the running gear between the inside and outside rails, a known running gear is provided with a middle wheel set that can be displaced transversely.

The use of rod assemblies to couple the transverse displacements of the middle wheel sets with the wheel attitude of the end wheel sets is already known from different arrangements, but in most cases these are influenced by longitudinal forces through tractive or braking forces of the rail vehicle such that the control effect is negatively influenced.

The object of the invention is to create a three-axle running gear for rail vehicles which permits a limiting of the transverse forces acting on the displaced end wheel set and which also represents a structurally simple and robust solution.

This is achieved according to the invention in that the bogey frame, seen in longitudinal direction, has several sections, wherein at least the frontmost section, seen in the direction of travel of the rail vehicle, in which the leading wheel set is arranged, is connected horizontally pivotable to a second, rigid section. Because the transverse displacement of the end wheel set no longer takes place, as in the state of the art, with separate pull rods, but according to the invention directly by means of a pivotable section of the bogey frame, an extremely robust design is achieved which allows a limiting of the transverse force even at axle loads up to 250 kN and at travel speeds up to 230 km/h.

According to a preferred embodiment example of the invention the bogey frame has three sections, in each of which a wheel set is housed, wherein the front section with the leading wheel set and/or the rear section with the trailing wheel set is or are connected horizontally pivotably to the middle rigid section.

In order to be able to keep the ratio between the forces acting substantially transversely to the longitudinal direction of the running gear and those acting vertically on a wheel set to permissible values, preferably smaller than 1:3, a further embodiment example of the invention provides that the steering device is formed and arranged for the transverse displacement of at least one end wheel set by more than 30 mm, preferably more than 50 mm, wherein transverse displacements of 90 mm and more are also possible and desired.

According to a further preferred embodiment example of the invention the steering device has two wheel set guides which are formed by pivotable parts of the bogey frame, wherein the substantially parallel wheel set guides which are arranged opposing in relation to the middle longitudinal axis of the bogey frame are hinged at their one end to the rigid part of the bogey frame and coupled to each other via a guide rod preferably attached to the opposite end. In other words, the parts of the bogey frame that are arranged in longitudinal direction of the running gear in the front and/or rear section of the bogey frame are pivotably housed at the middle rigid section of the bogey frame and in this way form two wheel set guides arranged parallel on both sides of the middle longitudinal axis of the running gear, wherein the parallelism of the two wheel set guides is ensured via a guide rod coupling the two wheel set guides to each other. That is to say, the pivotable section of the bogey frame is displaced as a parallelogram transversely to the longitudinal axis of the bogey frame.

In order to give the bogey frame according to the invention the necessary stability despite the pivotability of a section of the bogey frame, it is provided according to a further embodiment of the invention that the wheel set guides are formed substantially L-shaped seen from the side and are connected spatially movable with their vertical legs via at least one, preferably two joint(s), preferably rocker bearings, to the rigid part of the bogey frame, whereby not only is the pivotable section of the bogey frame horizontally movable but also vertical relative movements between the pivotable and the rigid section of the bogey frame can be compensated.

In order to be able to keep small the wear occurring at the wheel sets as a result of the transverse displacement of the wheel set, it has proved advantageous if the lateral excursion of the wheel set guides, i.e. the transverse displacement of the pivotable section of the bogey frame, is limited, this being achieved according to a further embodiment example if the steering device has an adjusting device for aligning the horizontally pivotable section of the bogey frame in longitudinal direction of the rigid bogey frame section.

A structurally simple solution results if the adjusting device has at least two, preferably hydraulic, adjusting cylinders operating diametrically opposed, which are each allocated to a wheel set guide and housed movable in rotation to a wheel set guide with one end and connected at the opposite end to the rigid bogey frame section, preferably to a holding element, projecting into the pivotable front section of the bogey frame, of the rigid bogey frame section.

If the adjusting cylinders operatively connected via a supply line each have an inner cylinder arranged movable in the adjusting cylinder casing and also a piston housed movable in the inner cylinder, the adjusting cylinders not only serve as a limiting device for lateral excursion of the pivotable section of the bogey frame, but also make possible the alignment of the pair of wheel set guides with the exact longitudinal direction of the bogey frame, especially if the two pistons of the two adjusting cylinders can be or are acted on by a system pressure that can preferably be changed.

To this end, according to a further embodiment example of the invention the supply lines are connected to a memory, preferably a bubble memory, for the pressure medium, wherein the system pressure is kept largely constant via the bubble memory and the supply lines.

As the lateral excursion of the movable frame parts can be set via the system pressure prevailing at the adjusting cylinders, it is possible, via the system pressure, to limit the transverse forces acting on the wheel set and keep them in a range in which firstly the wear occurring is as small as possible and secondly rolling motions which can occur when there are freely mobile frame parts of the bogey frame can be reduced or completely avoided.

In order to minimize the wear at the mechanical stops, a further embodiment example of the invention provides that the inner cylinder and/or the piston of at least one adjusting cylinder is/are damped in one or both end-positions by a damping device, wherein it has proved advantageous for an effective damping of the vertical, lateral and longitudinal movements of the wheel set or of the wheel set bearing if the preferably hydraulic damping element can be set according to the travel speed of the rail vehicle and/or the excursion of the pivotable section of the bogey frame and/or the direction of movement of the inner cylinder(s).

To transmit the tractive and braking forces of the wheel sets to the bogey frame, a further embodiment example of the invention provides that at least one wheel set of the running gear is coupled to the rigid section of the bogey frame via preferably two pull-push rods, wherein the pull-push rods are movably connected at their one end to the axle box case preferably formed as carrier for the primary springs and at their other end to the rigid section of the bogey frame.

If the distance between the reversing points of the pull-push rods is greater, at least at a wheel set arranged in a pivotable section of the bogey frame, than the distance between the reversing points of the pull-push rods at the rigid section of the bogey frame, the result, as a consequence of the angled arrangement of the pull-push rods, is a steering angle by which the wheel set axle that is normal to the longitudinal axis of the rigid section of the bogey frame when travelling straight ahead can be pivoted. The steering angle depends on the spread angle which the two pull-push rods arranged at an angle enclose with each other.

In order to compensate the inequality during the lateral excursion between the wheel set, loose in itself, and the pivotable frame parts of the bogey frame that are guided by means of the adjusting cylinders, and thus prevent the primary springs arranged between the wheel set and the pivotable parts of the bogey frame from being too greatly warped or twisted, a further embodiment example of the invention provides that, between the primary springs of the wheel set and the pivotable parts of the bogey frame, preferably plate-shaped sliding elements are arranged against which the primary springs rest with their end lying opposite the carrier, wherein a structurally particularly simple solution is obtained if the sliding elements are attached movably, preferably centered via a pin, to the pivotable parts of the bogey frame.

To relieve the running gear of the braking forces transmitted by means of the pull-push rods from the wheel sets to the running gear, it is provided according to a further embodiment example of the invention that the running gear is connected to the vehicle body of the rail vehicle via a device for the transmission of the braking and tractive forces, wherein the device has a first linking element hinged to the vehicle body and a second linking element hinged to the running gear, in particular to the rigid section of the bogey frame, and a connection element connecting the two linking elements, wherein as small as possible a wheel set relief is achieved if the device for the transmission of the braking and tractive forces is arranged lying deeper relative to the wheel set axles.

BRIEF DESCRIPTION OF THE DRAWINGS

Further details and advantages of the present invention are explained in more detail below with the help of the description of the Figures with reference to the embodiment examples in the drawing. There are shown in.

DETAILED DESCRIPTION

Figure 1A:
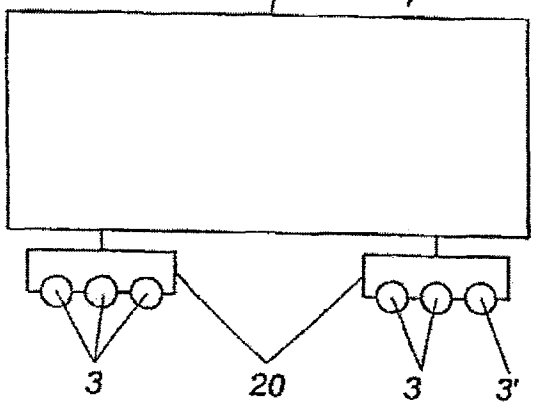
FIGS. 1*a* and 1*b* schematically a side view and a top view of a rail vehicle with a running gear according to the invention, FIGS. 2*a* to 2*c* different embodiment examples of a running gear according to the invention, FIGS. 3*a* and 3*b* a side view and a top view respectively of a further embodiment example of a running gear according to the invention, FIG. 4*a* the pivotable section of a bogey frame in which the wheel set is connected to a steering device, FIG. 4*b* the position of the adjusting cylinders of the steering device with laterally pivoted section of the bogey frame, FIG. 5 a pivotable section of a bogey frame in which the wheel set is connected via pull-push rods to the rigid section of the bogey frame, FIG. 6*a* schematically a side view of a running gear according to the invention with a device for the transmission of the braking and tractive forces and FIG. 6*b* a sectional representation along the section surface C-C from FIG. 6*a*.
Figure 1B:
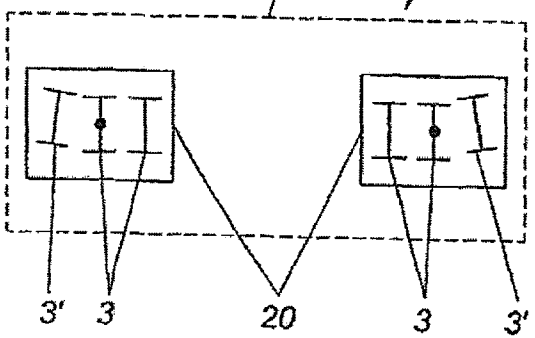

FIGS. 1*a* and 1*b* show schematically a rail vehicle 1 in side view and top view, in which the vehicle body 24 is housed on two running gears 20 according to the invention. Every running gear has three wheel sets 3, 3', which are arranged in a bogey frame. It can be seen in particular from FIG. 1*b* that the two end wheel sets 3' of the running gears 20 of the rail vehicle 1 are swung out or transversely displaced.

Figure 2B:
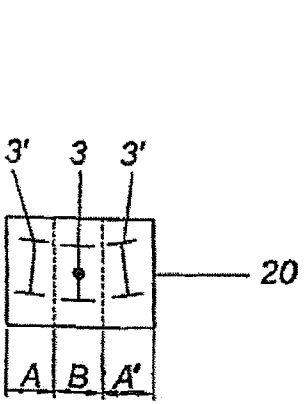
Figure 2A:
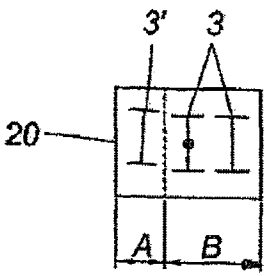
Figure 2C:
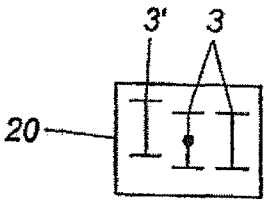

FIGS. 2*a* to 2*c* show several arrangement possibilities for wheel sets 3, 3' in a running gear according to the invention 20. In FIG. 2*a* only the front end wheel set 3' is arranged transversely displaceable or pivotable in the running gear 20, whereas in FIG. 2*b* both end wheel sets 3' are attached transversely displaceable or pivotable to the bogey frame. In the embodiment example according to FIG. 2*c* the front end wheel set 3' is again arranged transversely displaceable or pivotable in the running gear 20. However, contrary to the embodiment examples according to FIGS. 2*a* and 2*b*, the wheel set 3' is not pivoted. In all the embodiment examples shown, the pivot point of the running gear is located vertically above the middle rigid wheel set 3.

Figure 3A:
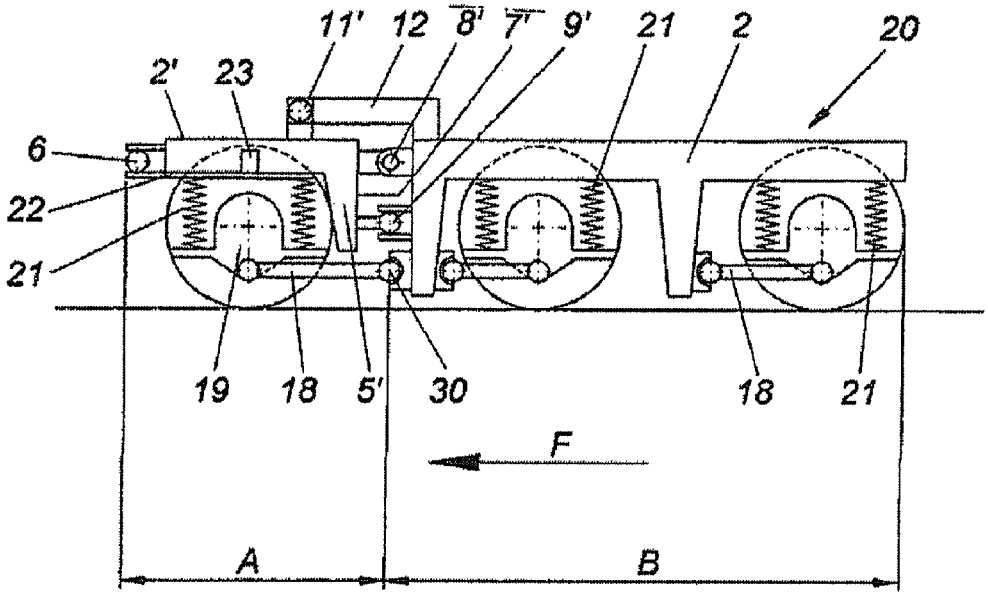
Figure 3B:
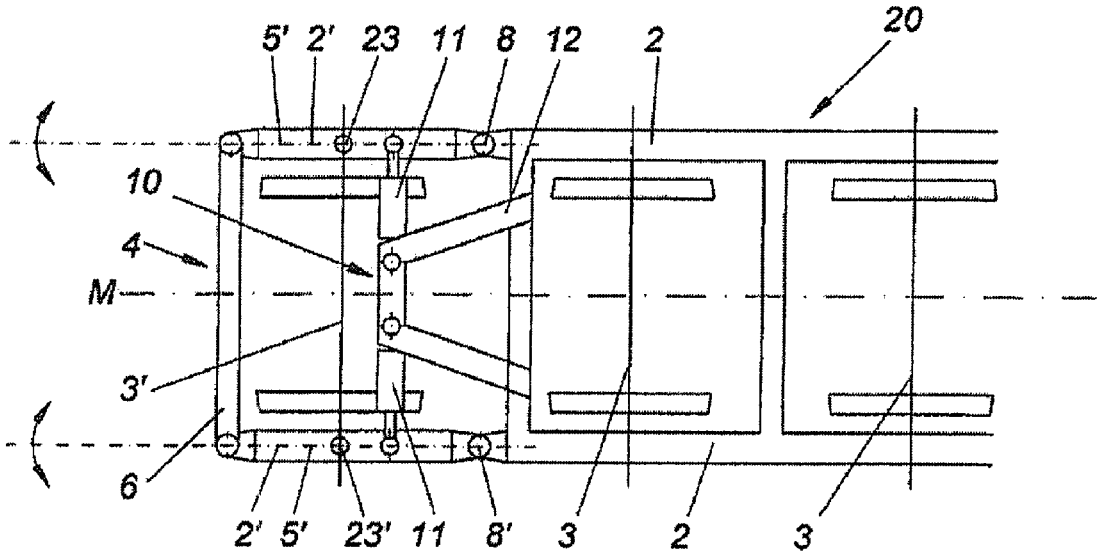

FIGS. 3*a* and 3*b* are schematic diagrams and show in a side view and a top view a first embodiment example of a running gear according to the invention 20. The running gear 20 has a bogey frame 2, 2' in which section A, the frontmost seen in the direction of travel F, is connected horizontally pivotable to the second rigid section B of the bogey frame 2, 2'. In this front section A there are arranged, on both sides of the middle longitudinal axis M of the bogey frame 2, 2', parallel wheel set guides 5, 5' which at their one end are connected pivotable to the rigid section B of the bogey frame 2, 2', while at their opposite ends they are coupled to each other via a guide rod 6. The wheel set guides 5, 5' formed by pivotable parts of the bogey frame 2, 2' are, seen from the side, formed substantially L-shaped and are movably connected with their vertical legs 7, 7' via two joints 8, 8', 9, 9', preferably ball joints, to the rigid section B of the bogey frame 2, 2'. It has proved favourable if the upper joint 8, 8' is formed as a rigid bearing carrier in vertical direction and the lower joint 9, 9' as a movable bearing in vertical direction.

At least the axle box case 19 of the wheel set 3' arranged in the pivotable section A of the bogey frame 2, 2' is simultaneously formed as carrier for the primary springs 21, wherein the primary springs 21 rest, at the end lying opposite the carrier, against a plate-shaped sliding element 22. In order to minimize the warping/twisting forces acting on the primary springs 21 as a result of the different radial excursion of the wheel set guides 5, 5' and the wheels of the wheel set 3, the plate-shaped sliding elements 22 are housed rotatably centered at the wheel set guides 5, 5' via pins 23.

In order to align the pivotable section A of the bogey frame 2, 2' with the exact longitudinal direction L of the rigid section B of the bogey frame 2, 2' an adjusting device 10 is arranged which has two adjusting cylinders 11, 11' working against each other. Both adjusting cylinders 11, 11' are housed hinged at their outer end to the wheel set guides 5, 5' and, at their ends pointing towards each other, connected preferably rotatable to a rigid holding element 12 which is connected to the rigid section B of the bogey frame 2, 2' and projects into the pivotable section A of the bogey frame 2, 2'. The transverse displacement of the pivotable section A of the bogey frame 2, 2' is thus limited via the adjusting cylinders 11, 11', as will be explained later with reference to FIGS. 4*a* and 4*b*.

The wheel set 3' of the pivotable section A of the bogey frame 2, 2' is kept on track via pull-push rods 18, 18'. In order to minimize the wear when travelling round bends, the pull-push rods 18 are arranged such that the pull-push rods 18, 18' enclose a spread angle α, wherein the pull-push rods 18, 18' run conically from the wheel set 3' in the direction of the rigid section B of the bogey frame 2, 2'. The pull-push rods 18, 18' are rotatably attached to the axle box case 19 of the wheel set 3' and to the rigid section B of the bogey frame 2, 2', wherein the housing of the pull-push rods 18, 18' at the rigid section B of the bogey frame 2, 2' preferably takes place via an elastomeric element.

The mode of operation of the adjusting device 10 for aligning the pivotable section A of the bogey frame 2, 2' is explained below in more detail with reference to FIGS. 4*a* and 4*b*. As can be seen from FIG. 4*a*, the two adjusting cylinders 11, 11' each have a cylinder casing 13, 13' and also an inner cylinder 14, 14' arranged in the cylinder casing 13, 13' with a piston 15, 15' movable therein. The two adjusting cylinders 11, 11' are operatively connected to each other via a supply line 31, wherein the pistons 15, 15' of the two inner cylinders 14, 14' are acted upon by pressure via the supply line 31. In order that this pressure can be kept constant, the supply line 31 is connected to a bubble memory 16. This means that the ratio occurring at the edges of the wheel set 3' between the transverse force and the vertical force is limited, wherein the ratio of forces can be variably set if the system pressure can be changed.

Both end-bearings of the inner cylinders 14, 14' and of the cylinder pistons 15, 15' are damped via hydraulic damping elements 17, 17', in order on the one hand to keep small the wear at the adjusting cylinders 11, 11' and on the other hand avoid sudden movements when pivoting the wheel set guides 5, 5'. Both adjusting cylinders 11, 11' are fitted with hydraulic damping elements 17, 17' in the form of damping circuits which damp the movement of the inner cylinders 14, 14'. The degree of damping can be regulated depending on the speed of the vehicle and/or depending on the pivot frame excursion and/or depending on the direction of movement of the inner cylinder.

Figure 4B:
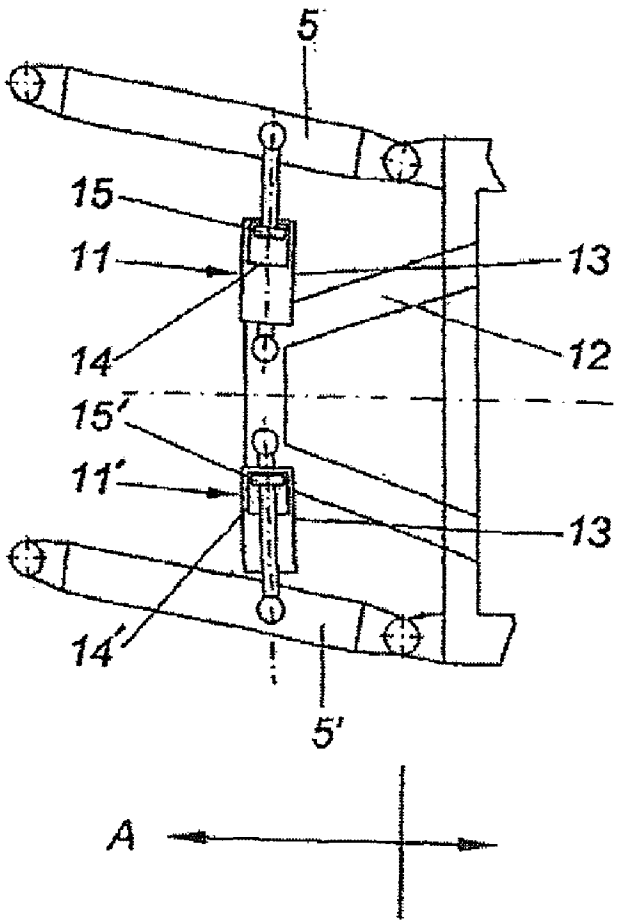
Figure 4A:
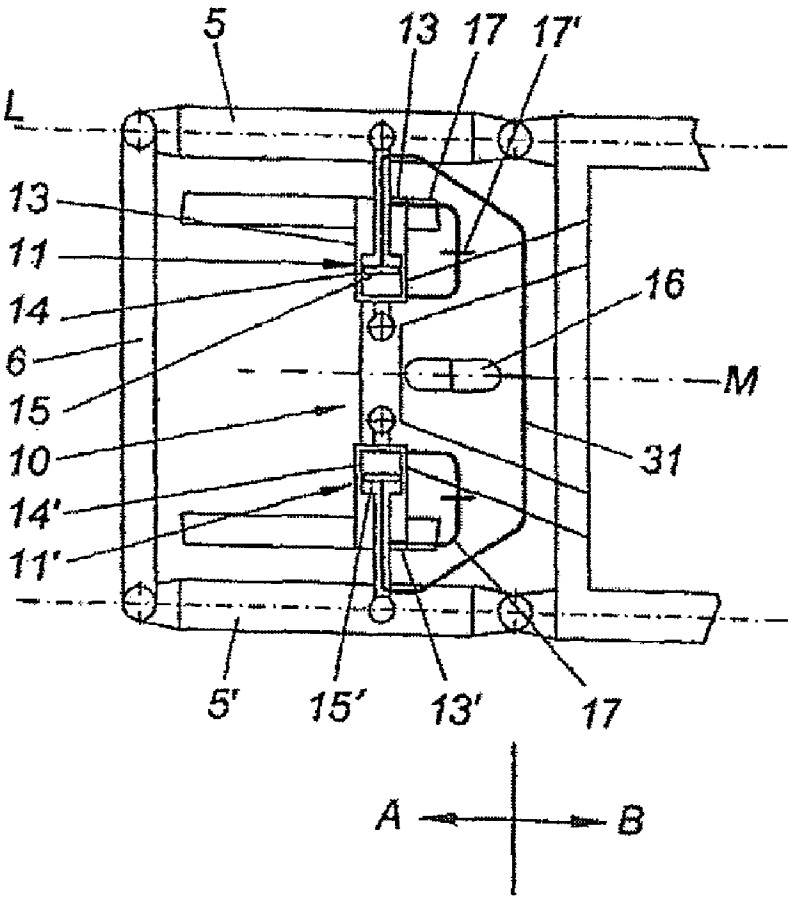

As can be seen in FIG. 4*a*, when travelling straight ahead, i.e. when the wheel set guides 5, 5' of the pivotable section A of the bogey frame 2, 2' are aligned in longitudinal direction L of the rigid section B of the bogey frame 2, 2', the two inner cylinders 14, 14' are fully retracted, i.e. they are located in the end-zones, facing the middle longitudinal axis M, of the bogey frame 2, 2', of the cylinder casings 13, 13'. The pistons 15, 15', on the other hand, are extended and are located in the outside end-zones of the inner cylinders 14, 14'.

In FIG. 4*b* the pivotable section A of the bogey frame 2, 2' is swung out to the right. For reasons of clarity, the supply line 31 and also the damping elements 17, 17' have not been shown. It can be seen in the Figure that, when the excursion of the pivotable section A in the adjusting cylinder 11 is at its maximum, the inner cylinder stands in the end-zone allocated to the wheel set guide 5 of the cylinder casing 13 and the piston 15 is fully extended, i.e. it stands at the end allocated to the wheel set guide 5 of the inner cylinder 14. In the case of the adjusting cylinder 11' lying opposite, on the other hand, the inner cylinder 14 is located in the end-zone facing away from the wheel set guide 5' of the cylinder casing 13 and the piston 15' is fully retracted, i.e. stands at the end facing away from the wheel set guide 5' of the inner cylinder 14.

Figure 5:
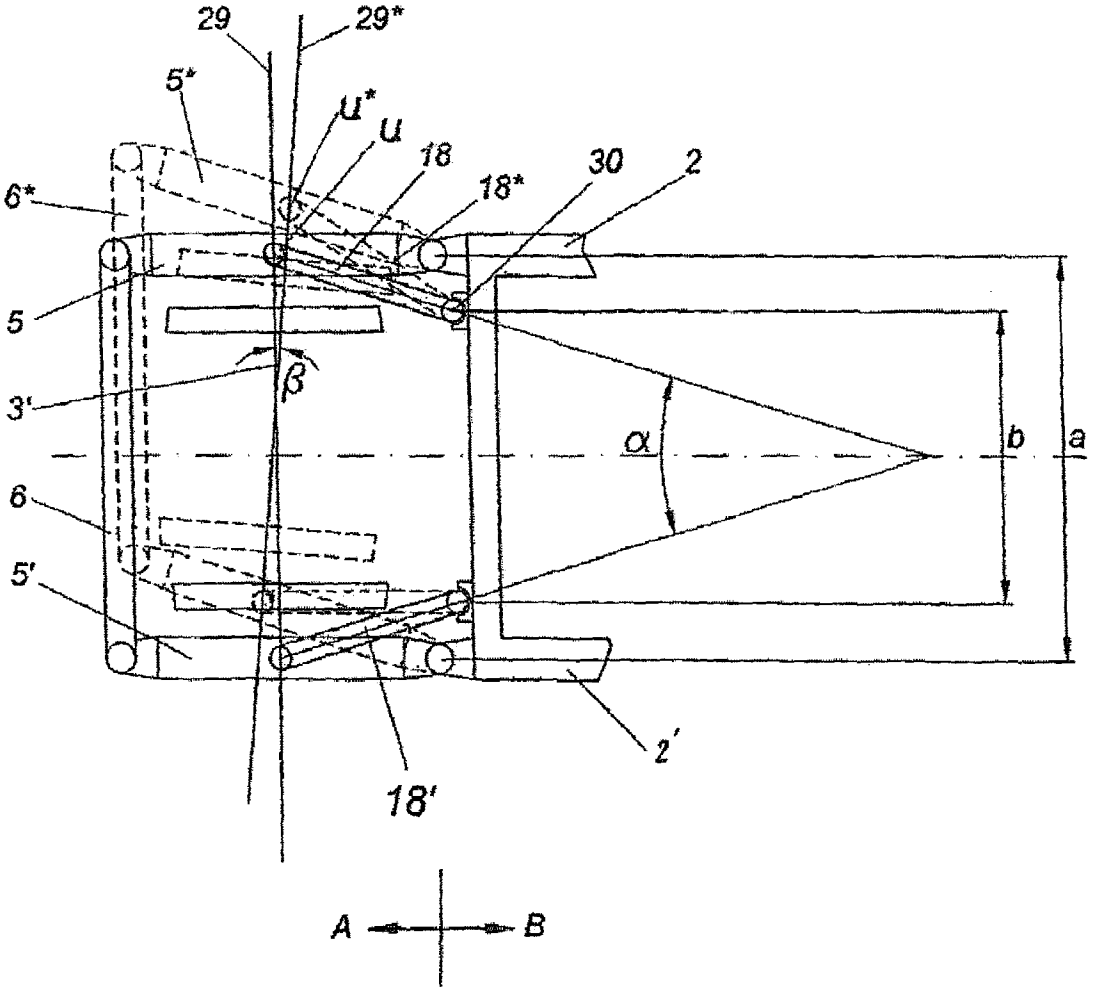

The articulation of the wheel set 3' via pull-push rods 18, 18' is represented schematically in FIG. 5. The solid lines show the pivotable section A of the bogey frame when travelling straight ahead, while the broken lines show the front section of the bogey frame 2, 2' in the swung-out position. For reasons of clarity, the axle box case to which the pull-push rods are attached are not shown.

The pull-push rods 18, 18' arranged at the spread angle α are rotatably housed at the rigid section of the bogey frame 2, 2' by means of an elastomeric element 30. Upon pivoting of the wheel set guide 5 into the maximum swing-out position 5*, the wheel set 3' is also displaced to the right, with the result that the reversing point u of the pull-push rod 18 is moved, because of the rotatable housing of same at the rigid part B of the bogey frame 2, 2', along a circular path into its final position u*. The same also applies of course to the reversing point of the pull-push rod 18'. The displacement of the reversing points results in a pivoting of the wheel set axle of the wheel set 3', wherein the angle of pivot of the wheel set axle corresponds to the steering angle β. The steering angle β depends directly proportionally on the spread angle α which the two pull-push rods 18, 18' enclose with each other.

In the case of the running gear according to the invention the transverse displacement of the leading wheel set 3' is thus made possible by means of the pivotable section A of the bogey frame 2, 2', wherein the leading wheel set 3' is not actively controlled, but kept on track by an adjusting device 10 in order to absorb defined tracking forces and avoid excessive rolling. To reduce the wear at the edges of the leading wheel set 3' the running gear 20 according to the invention is furthermore connected via conically arranged pull-push rods 18, 18' to the rigid section B of the bogey frame 2, 2', which allows a steering angle β to be fixed. In the case of the running gear according to the invention 20, both a permissible range for the transverse displacement of the pivotable section A of the bogey frame 2, 2' and a permissible range for the swinging out of the leading wheel set 3' are thus fixed.

Figure 6A:
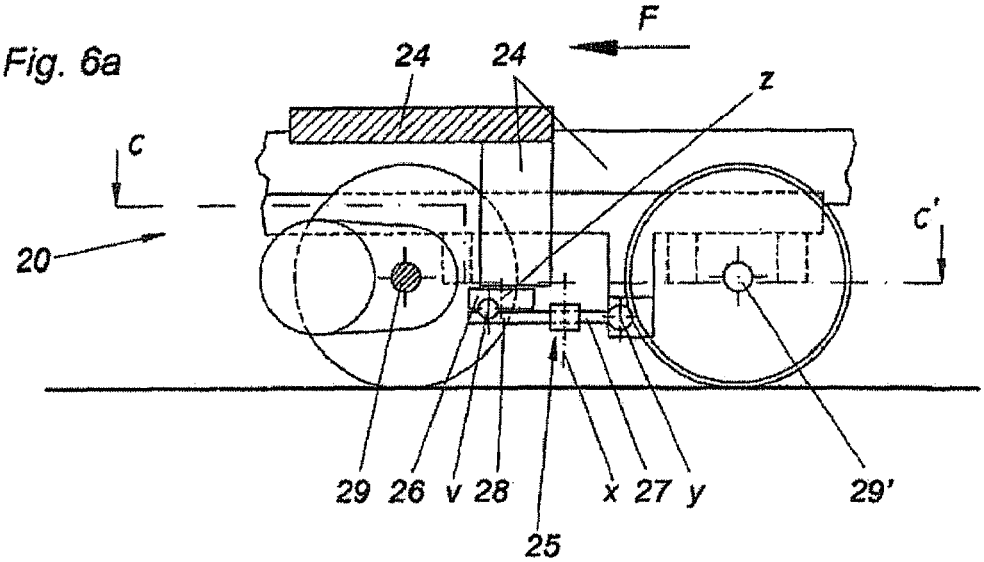
Figure 6B:
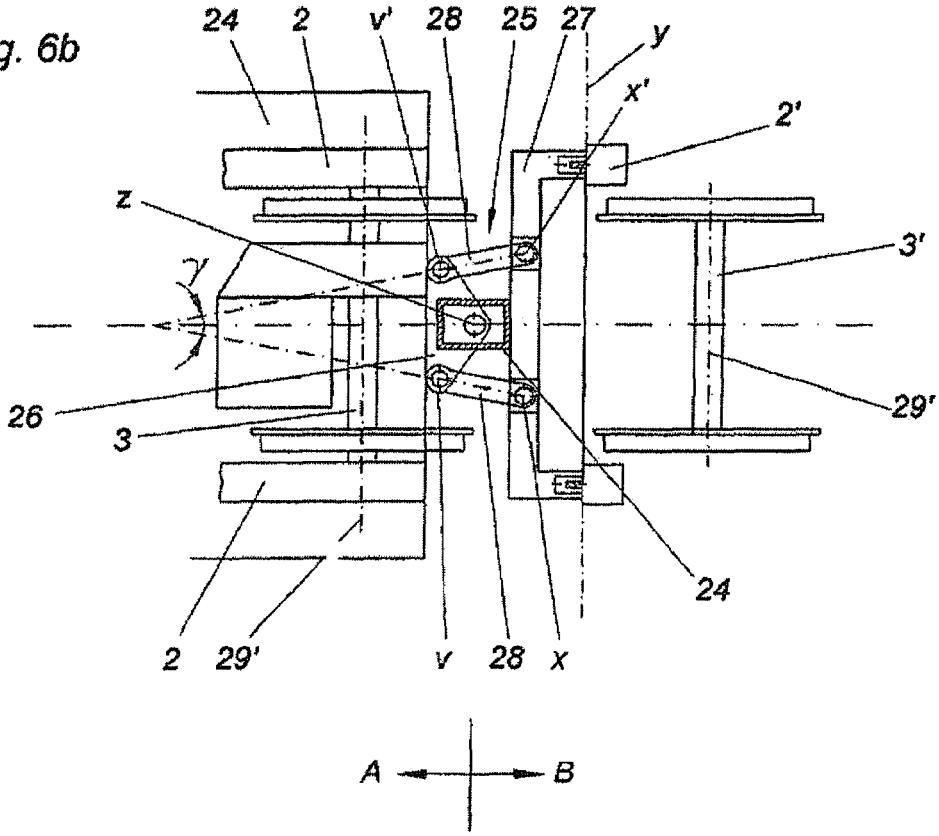

FIG. 6*a* shows schematically in a view and FIG. 6*b* in a sectional view along the section surface C-C a running gear 20 according to the invention with a device 25 for the transmission of the braking and tractive forces from the running gear 20 to the vehicle body 24. The device 25 has a first linking element 26, a second linking element 27 and a connection element 28 connecting the two linking elements 26, 27 and is arranged lying deeper in relation to the wheel set axles 29, 29'. The first linking element 26 is housed horizontally rotatable about a vertical axis z with the vehicle body 24. The second linking element 27 is formed yoke-shaped and housed rotatable about a horizontal axis y with the rigid section B of the bogey frame 2, 2'. The connection element 28 has two pull rods which are arranged in one plane inclined relative to each other and are rotatably connected on one side to the second linking element 27 about a vertical axis x and on the other to the first linking element 26 via ball joints v, v'. The angle γ which the two pull rods of the connection element 28 enclose with each other and which does not equal zero ensures that the radial alignment of the rigid section B of the bogey frame 2, 2' can be influenced by the lateral relative movement between the rigid bogey frame section B and the vehicle body 24.

The same effect could also be achieved if the first and the second linking element as well as the connection element are pivotal in horizontal planes relative to each other and the first and/or the second linking element is/are hinged to the running gear or to the vehicle body via a ball joint.

The represented embodiment examples of rail vehicles according to the invention with several wheel sets housed in a bogey frame and a steering device making possible a transverse displacement of an end wheel set are not of course to be understood in the restrictive sense, but merely as single examples of numerous possibilities of realizing the inventive idea of a steering device for a rail vehicle with a 3-axle running gear in which the steering device comprises pivotable bogey frame parts.

What is claimed is:

1. Running gear for rail vehicles with at least three wheel sets housed in a bogey frame and at least one steering device that makes possible a transverse displacement of an end wheel set, wherein the bogey frame has several sections, and wherein at least the frontmost section, in which a leading wheel set is arranged, is connected horizontally pivotable to a second, rigid section, characterized in that at least the frontmost section, as seen in the direction of travel of the bogey frame in which the leading wheel set is arranged, is formed as a parallelogram that can be displaced transversely to the longitudinal axis of the bogey frame; and wherein said at least one steering device has (i) an adjusting device for aligning the horizontally pivotable section of the bogey frame in longitudinal direction of the rigid bogey frame section, (ii) two wheel set guides which are formed by pivotable parts of the bogey frame, and further wherein the adjusting device has at least two adjusting cylinders operating against each other are each housed movable in rotation to a wheel set guide with one end and connected with their opposite end to the rigid bogey frame section, to a holding element, projecting into the pivotable section of the bogey frame, of the rigid bogey frame section.

2. Running gear according to claim 1, characterized in that the two adjusting cylinders operatively connected via a supply line, each said cylinder has an inner cylinder arranged movable in an adjusting cylinder casing and also a piston housed movable in the inner cylinder, wherein the pistons of the two adjusting cylinders can be or are acted on by a system pressure.

3. Running gear according to claim 2, characterized in that the supply line is connected to a memory.

4. The running gear of claim 3 wherein said system pressure is controlled by a bubble memory.

5. Running gear according to claim 2, characterized in that the inner cylinder and/or the piston of at least one adjusting cylinder is/are damped in one or both end-positions by means of a damping device.

6. Running gear according to claim 5, characterized in that the damping device can be set according to a travel speed of the rail vehicle and/or a swinging out of the pivotable section of the bogey frame and/or the direction of movement of the inner cylinder.

7. The running gear of claim 2 wherein said system pressure is changeable.

8. Running gear for rail vehicles with at least three wheel sets housed in a bogey frame and at least one steering device that makes possible a transverse displacement of an end wheel set, wherein the bogey frame, has several sections, wherein at least the frontmost section, in which a leading wheel set is arranged, is connected horizontally pivotable to a second, rigid section, characterized in that at least the frontmost section, seen in the direction of travel of the bogey frame in which the leading wheel set is arranged is formed as a parallelogram that can be displaced transversely to the longitudinal axis of the bogey frame and wherein the running gear is connected to a vehicle body of the rail vehicle via a device for transmission of braking and tractive forces, wherein said device has a first linking element hinged to the vehicle body and a second linking element hinged to the running gear, in particular to the rigid section, of the bogey frame, and a connection element connecting the two linking elements.

9. Running gear according to claim 8, characterized in that the device for the transmission of the braking and tractive forces is arranged lying deeper relative to wheel set axles.

10. A running gear for rail vehicles comprising:

at least three wheel sets housed in a bogey frame having several sections wherein seen in the direction of travel an at least frontmost section of said bogey frame, in which a leading wheel set is arranged, is connected horizontally pivotable to a second, rigid section and is formed as a parallelogram that can be displaced transversely to the longitudinal axis of said bogey frame and at least one steering device that makes possible a transverse displacement of an end wheel set, said steering device has two wheel set guides which are formed by pivotable parts of the bogey frame and an adjusting device for aligning said frontmost section of the bogey frame in longitudinal direction of said second, rigid section, wherein said adjusting device has at least two adjusting cylinders operating diametrically opposed, each of them being allocated to a wheel set guide.

11. A running gear according to claim 10, wherein said adjusting cylinders are hydraulic cylinders.

12. A running gear according to claim 10, wherein each of said adjusting cylinders is housed movable in rotation to a wheel set guide with one end and is connected with its opposite end to said second, rigid section of the bogey frame.

13. A running gear according to claim 12, wherein said adjusting cylinders are connected to a holding element of the second, rigid section, which projects into the pivotable frontmost section of the bogey frame.

14. A running gear according to claim 10, wherein said adjusting cylinders are operatively connected via a supply line and each has an inner cylinder arranged movable in an adjusting cylinder casing and also a piston housed movable in the inner cylinder, wherein the pistons of the two adjusting cylinders are acted on by a system pressure.

15. A running gear according to claim 14, wherein said system pressure can be changed.

16. A running gear according to claim 14, wherein said supply line is connected to a memory for a pressure medium.

17. A running gear according to claim 16, wherein said memory is in the form of a bubble memory.

18. A running gear according to claim 14, wherein said inner cylinder and/or the piston of at least one adjusting cylinder is/are damped in one or both end-positions by means of a damping device.

19. A running gear according to claim 18, wherein said damping device is set according to a travel speed of the rail vehicle and/or a swinging out of the pivotable frontmost section of the bogey frame and/or a direction of movement of the inner cylinder.

20. A running gear according to claim 18, wherein said damping device is a hydraulic damping device.

21. A running gear according to claim 10, wherein said bogey frame has three sections in each of which a wheel set is housed and wherein a front section with the leading wheel set and a rear section with a trailing wheel set are formed as a parallelogram that can be displaced transversely to the longitudinal axis of the bogey frame and are connected horizontally pivotably to the middle, rigid section.

22. A running gear according to claim 10, wherein said steering device is formed and arranged for the transverse displacement of at least one end wheel set by more than 50 mm.

23. A running gear according to claim 10, wherein said wheel set guides, which are arranged opposing in relation to the middle longitudinal axis of the bogey frame, are hinged at their one end to the second, rigid section of the bogey frame and coupled to each other via a guide rod.

24. A running gear according to claim 23, wherein said guide rod is attached to opposite free ends of said wheel set guides.

25. A running gear according to claim 10, wherein said wheel set guides are formed substantially L-shaped seen from a side and are connected spatially movable with their vertical legs via at least one joint to the second, rigid section of the bogey frame.

26. A running gear according to claim 25, wherein said wheel set guides are connected with their vertical legs via at least two joints.

27. A running gear according to claim 26, wherein said joints in the form of rocker bearings.

28. A running gear according to claim 10, wherein at least one wheel set of the running gear is coupled to the rigid section of the bogey frame via two pull-push rods.

29. A running gear according to claim 28, wherein said pull-push rods are movably connected at their one end to an axle box case and at their other end to the rigid section of the bogey frame.

30. A running gear according to claim 29, wherein said axle box case is formed as a carrier for primary springs.

31. A running gear according to claim 28, wherein an axle of the wheel set being coupled to the rigid section of the bogey frame via said pull-push rods is slewable about a steering angle $\beta$ relative to the longitudinal axis of the rigid section of the bogey frame.

32. A running gear according to claim 29, wherein a distance between reversing points of the pull-push rods at least at one wheel set arranged in a pivotable section of the bogey frame is greater than a distance between reversing points of the pull-push rods at the rigid section of the bogey frame.

33. A running gear according to claim 32, wherein said steering angle $\beta$ depends directly proportionally on spread angle $\alpha$ which the two pull-push rods enclose with each other.

34. A running gear according to claim 10, wherein sliding elements are arranged between primary springs of the wheel set and the wheel set guides against which the primary springs rest with their ends lying opposite a carrier.

35. A running gear according to claim 34, wherein said sliding elements are plate-shaped.

36. A running gear according to claim 34, wherein said sliding elements are attached movably, to the wheel set guides.

37. A running gear according to claim 36, wherein said sliding elements are centered via a pin to the wheel set guides.

38. A running gear according to claim 10, wherein the running gear is connected to a vehicle body of a rail vehicle via a device for transmission of braking and tractive forces, wherein said device has a first linking element hinged to the vehicle body and a second linking element hinged to the running gear, in particular to the rigid section of the bogey frame, and a connection element connecting the two linking elements.

39. A running gear according to claim 38, wherein said device for the transmission of the braking and tractive forces is arranged lying deeper relative to the wheel set axles.

* * * * *